US007070061B1

(12) United States Patent
Munnekehoff

(10) Patent No.: US 7,070,061 B1
(45) Date of Patent: Jul. 4, 2006

(54) SYSTEM FOR CONTROLLING MOVEMENTS OF A LOAD LIFTING DEVICE

(76) Inventor: Gerd Munnekehoff, Langestr. 80, 42857 Remscheid (DE)

( * ) Notice: Subject to any disclaimer, the term of this patent is extended or adjusted under 35 U.S.C. 154(b) by 144 days.

(21) Appl. No.: 10/129,246

(22) PCT Filed: Oct. 26, 2000

(86) PCT No.: PCT/EP00/10548

§ 371 (c)(1),
(2), (4) Date: Oct. 3, 2002

(87) PCT Pub. No.: WO01/32547

PCT Pub. Date: May 10, 2001

(30) Foreign Application Priority Data

Oct. 30, 1999 (DE) ..... 299 19 136 U

(51) Int. Cl.
*B66D 3/18* (2006.01)

(52) U.S. Cl. ..... 212/328; 212/330

(58) Field of Classification Search ..... 212/328, 212/270, 330

See application file for complete search history.

(56) References Cited

U.S. PATENT DOCUMENTS

| | | | | |
|---|---|---|---|---|
| 2,940,608 | A * | 6/1960 | Underwood et al. | 212/287 |
| 4,348,634 | A | 9/1982 | David et al. | |
| 5,850,928 | A * | 12/1998 | Kahlman et al. | 212/285 |
| 5,950,629 | A * | 9/1999 | Taylor et al. | 128/897 |
| 6,204,619 | B1 * | 3/2001 | Gu et al. | 318/568.11 |
| 6,272,924 | B1 * | 8/2001 | Jansen | 73/379.01 |
| 6,313,595 | B1 * | 11/2001 | Swanson et al. | 318/568.11 |
| 6,394,731 | B1 * | 5/2002 | Konosu et al. | 414/5 |
| 6,668,668 | B1 * | 12/2003 | Peshkin | 73/862.56 |

FOREIGN PATENT DOCUMENTS

| | | |
|---|---|---|
| DE | 198 25 312 | 3/1999 |
| GB | 2 110 428 | 6/1983 |
| WO | WO 86/07042 | 12/1986 |
| WO | WO 90/13508 | 11/1990 |
| WO | WO 98/43911 | 10/1998 |
| WO | WO 00/46570 | 8/2000 |

* cited by examiner

*Primary Examiner*—Thomas J. Brahan
(74) *Attorney, Agent, or Firm*—Merchant & Gould

(57) ABSTRACT

The invention relates to a system for controlling movements of a load lifting device on a horizontal plane whereby the load lifting device (6) comprises a vertically oriented carrier element (14). The vertical orientation of said carrier element is at least due to gravity when the element is in a resting position. At least one motor device (23*a*, 23*b*, 23*c*) is connected in order to execute said movements. Said movements can be controlled by a force impinging in a substantially horizontal direction relative to the carrier element (14), in particular a force which can be applied and which can be detected by a sensor device (25). In order to improve upon a control system in a simple to operate and low cost manner, in particular in such a way that load independent control is achieved with a high degree of positioning accuracy and rapid positioning speed, the sensor device (25), according to the invention, is embodied in such a manner and arranged in such a manner with respect to the carrier element (14) that the force is detected in a path-free manner. Path-free in this context is taken to mean that components of the sensor device (25) do not move through macroscopically registerable path with respect to each other.

27 Claims, 11 Drawing Sheets

Figure 3:
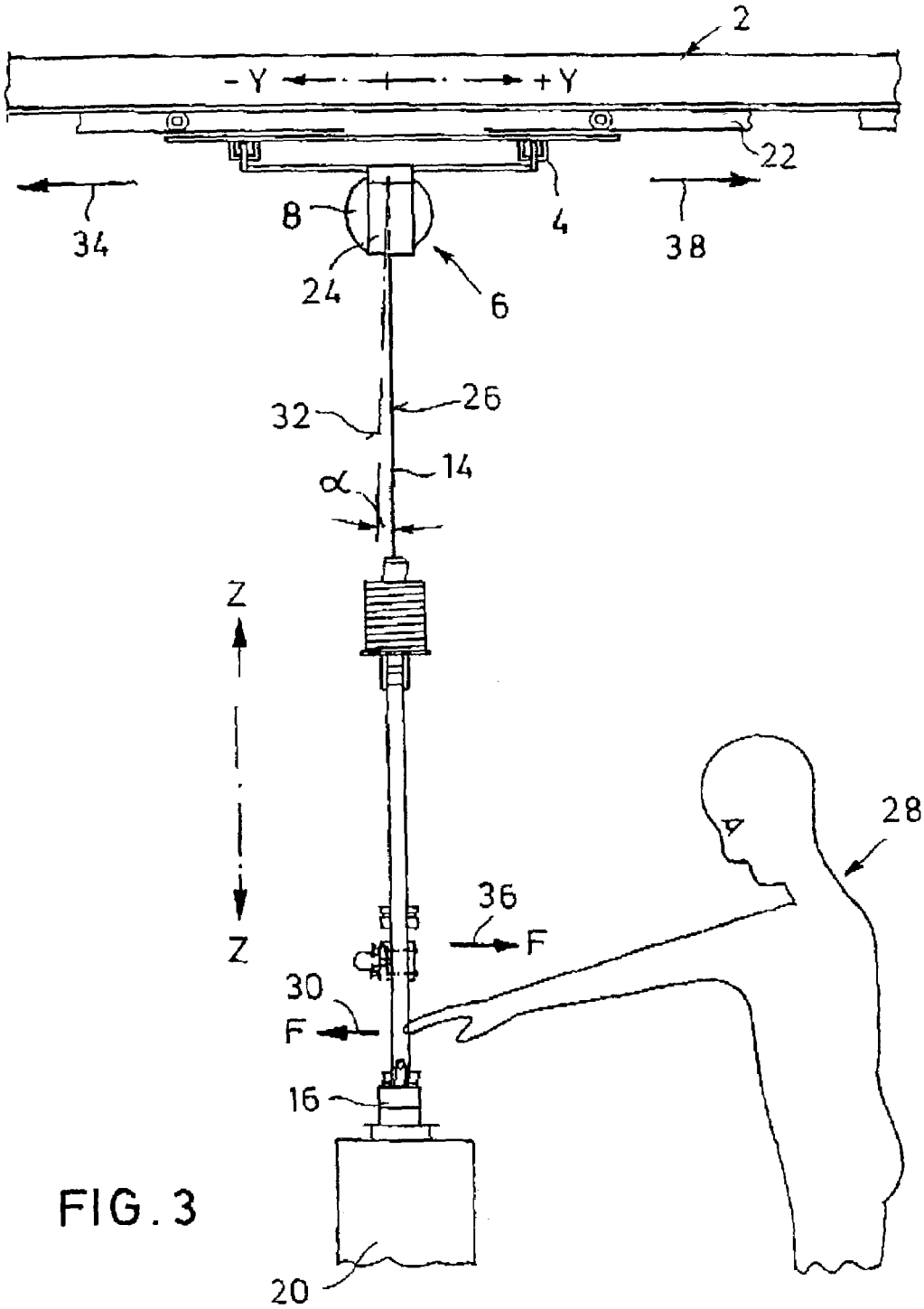

FIG.1
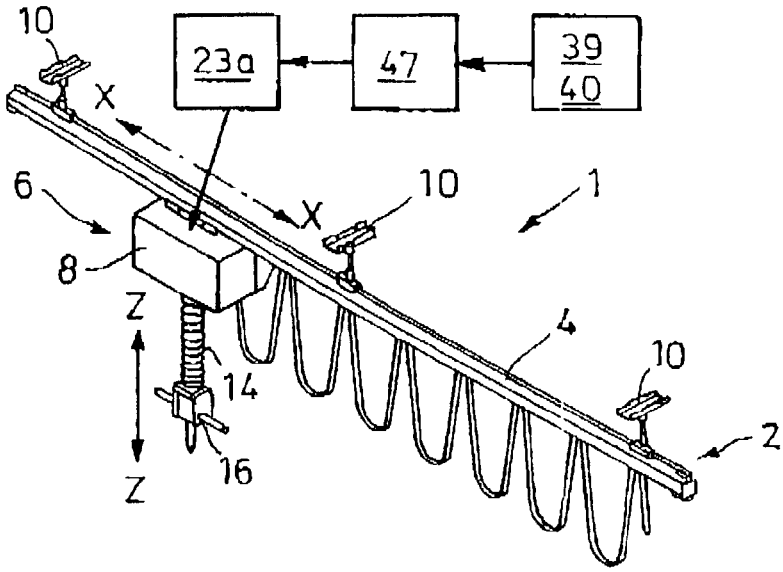
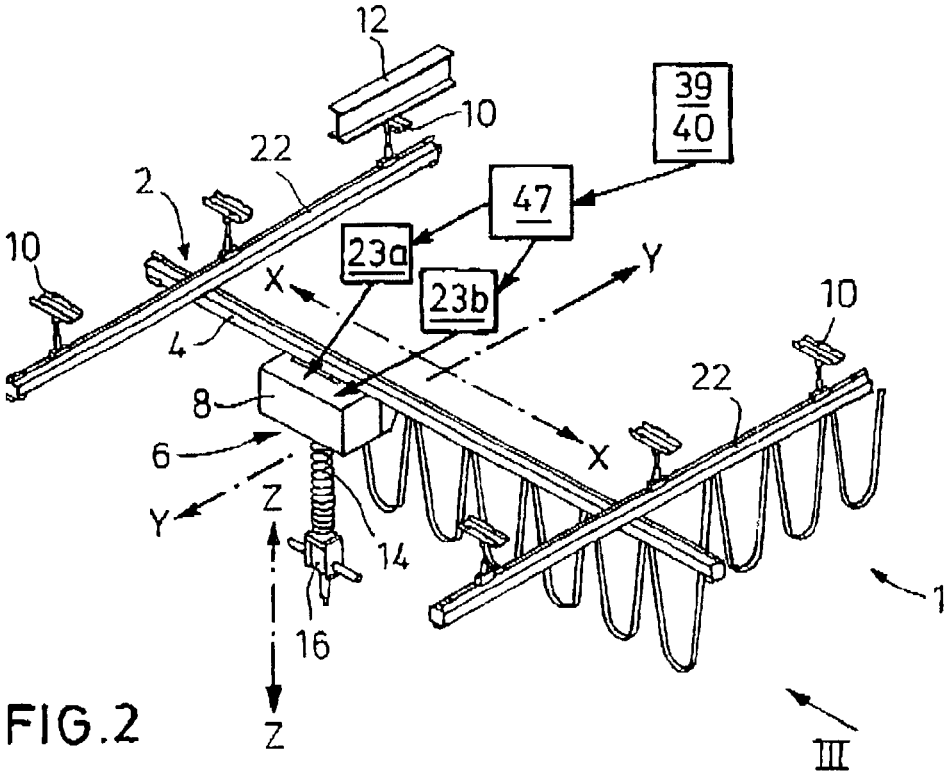
FIG.2

FIG.8
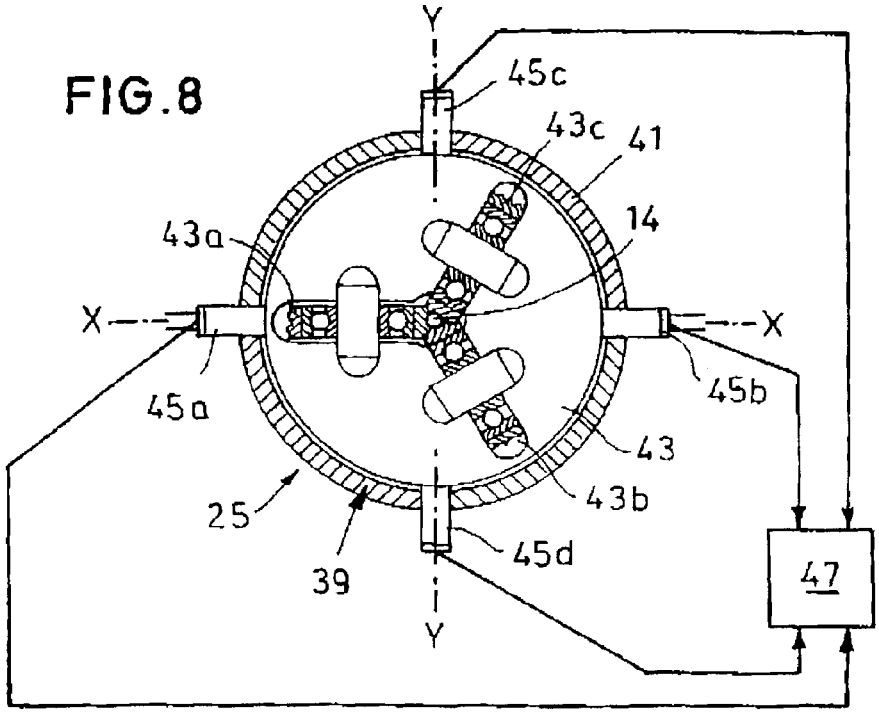
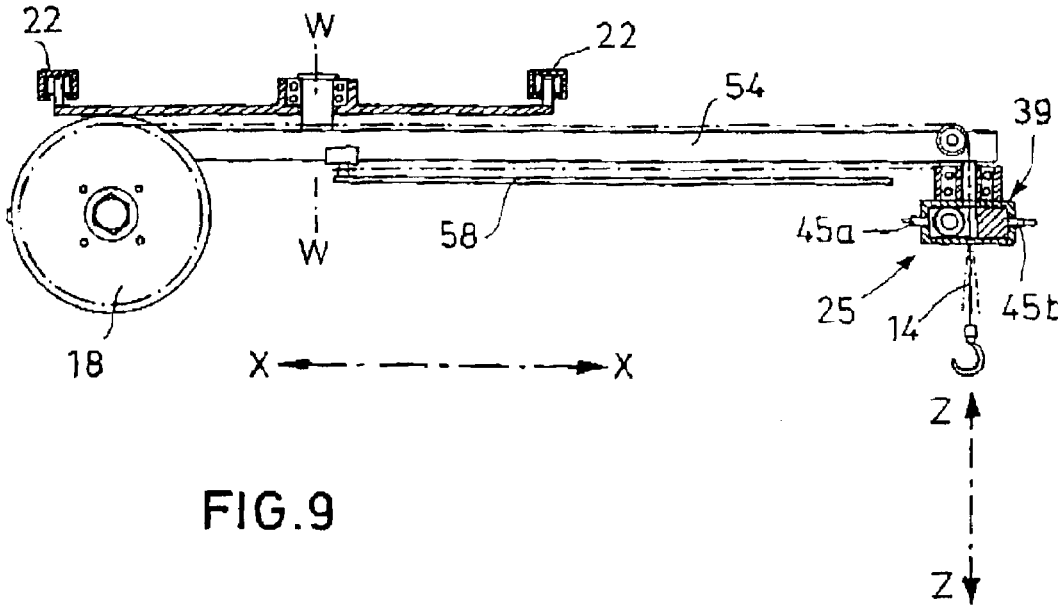
FIG.9

SYSTEM FOR CONTROLLING MOVEMENTS OF A LOAD LIFTING DEVICE

The invention under consideration refers to a system for controlling a load-lifting device, in particular, a crane traveling crab, conducted on a track construction, with regard to its movements in a horizontal plane, wherein the load-lifting device has a carrying element that at least in its position at rest and influenced by gravity, is vertically oriented, with the load-lifting device being correlated with at least one motor drive device to carry out the movements, which can be controlled as a function of the force that acts on the carrying element in an essentially horizontal direction and is applied, in particular, manually, and can be recorded with a sensor device.

In particular, the invention refers to such a system, in which the load-lifting device has a flexible carrying element that can swing and be wound, and which is oriented vertically in its position at rest and affected by gravity.

Crane runways with a traveling crab (one-track runway), which moves back and forth in only one coordinate direction, and also with a traveling crab (traveling crane), which moves over an area in two coordinate directions, are known. The traveling crab itself is conducted on one track; this track is then perhaps conducted on other tracks with one movement direction, vertical to its longitudinal extension. The load-lifting device or traveling crab has a flexible carrying element, which can be wound in many cases, for example in a carrier cable or a chain, which in its state at rest and affected by gravity is oriented vertically. Moreover, rigid, rod-like carrying elements are also often used. With the load-lifting device, a load can be raised or lowered in a vertical spatial direction, in that the carrying element is wound or unwound or, as a whole, is moved vertically.

In many such crane runways, the traveling crab is conducted, moving freely, over corresponding, free-running bearings, for example, rollers. Here, the horizontal movements of the traveling crab must be induced by the operator manually via the carrying element, in that the traveling crab is pulled or pushed in the corresponding direction with the carrying element or the load hanging on it. In the case of a flexible carrying element, great deflections of the carrying element may be required, depending on the height of the load, before the traveling crab moves at all. At the end of the individual movement, there is often also an undesired excess swiveling—that is, unwanted further movements of the traveling crab beyond the desired position, and perhaps relatively hard, against an end stop of the pertinent carrying track. Therefore, it is often necessary for the traveling crab or the carrying element to also be braked and perhaps even pulled back somewhat, once more. In this respect, a relatively wide, reverse deflection of the carrying element is then necessary. From all this, a poor, cumbersome, time- and effort-consuming operation results.

Crane runways with motor-driven traveling crabs are also known. Usually, the traveling crab drive is controlled from a driver's cabin or a manual keyboard via corresponding, for example, electrical, switches. Problems arise hereby. Above all, swinging movements of the load hanging on the carrying element result from each change of speed—that is, from each acceleration and braking operation. In unfavorable cases, such swinging or oscillation movements can be so strong that, for example, a free-standing crane can even tip over.

In order to create a system for controlling a load-lifting device, in particular, a system for controlling the movement of a crane traveling crab, which is conducted on a track construction and has a vertically oriented carrying element that, in a control-technical simple manner, ensures a particularly comfortable operation with a simultaneously high degree of safety, the German Utility Model, West German Patent No. 297 12 462 U1, teaches the correlation of the load-lifting device to carry out the movements and at least one motor drive device that can be controlled as a function of a force that acts on the carrying element in an essentially horizontal direction. This force, which is to be applied manually, in particular, is recorded by means of a sensor device in the known system. Thus, the operator now needs only to apply a slight manipulation force directly on the load or in the area of the load holding device, wherein the lifting device moves with the load in the corresponding direction, automatically, by means of the motor. Without the effect of force, the load comes to a standstill immediately. The load can therefore be very sensitively and precisely manipulated and placed.

The pertinent force can be recorded in the known system directly, for example, by means of DMS technology (DMS=wire strain gauge), which is possible, above all, when using a rigid carrying element, wherein the individual manipulation force can be transferred via the rigid carrying element, almost without deflections, to a sensor device, located in the area of the load-lifting device.

Alternately and as is well known, an indirect force recording is provided, above all, when using a carrying element that is flexible and therefore can swing, in that deflections of the carrying element, which are independent of the individual manipulation force and that are forced with respect to the vertical, are recorded. To this end, a sensor device is provided, with which deflections of the carrying element, relative to the vertical, are recorded, and which then produce signals to control the drive device of the load-lifting device, as a function of the direction and preferably also the degree of deflection. The sensor device of the known system has a measuring unit that, on the one hand, consists of a deflection element, connected with the carrying element, and on the other hand at least one distance sensor. The distance sensor is held, horizontally, next to the deflection element, at a certain distance, which can change by means of the manipulation force. Thus, a path-dependent force recording is available. One disadvantage of this known system is in that the operating forces are dependent on the load—that is, with bigger loads, for example, with loads above 100 kg, a higher manipulation force must be applied than with smaller loads, so as to deflect the carrying element with respect to the vertical by one and the same amount.

The goal of the invention under consideration is to improve a control system of the aforementioned type, in a simple and low-cost manner, with respect to its operating comfort, particularly in such a way that, a load-independent control can take place with a high positioning accuracy and a rapid positioning speed.

This is attained, in accordance with the invention, in that the sensor device is designed in such a way, and is situated with reference to the carrying element, so that the force is recorded path-free. "Path-free" is thereby understood to mean that the parts of the sensor device, relative to one another, do not traverse any macroscopically recordable paths.

Wire strain gauge-force recorders, magnetoelastic force recorders, piezoelectric force recorders, or fiber-optical force recorders can be advantageously used as path-free force recorders, in accordance with the invention.

For an advantageous operation, the sensor device can be designed, with respect to the production of control signals, in such a way that a movement of the load-lifting device in a certain coordinate direction is brought about by the force of the carrying element, approximately in the same direction and essentially corresponding to the desired movement direction. The sensor device can be sensitively designed in such a way that even a very small force, such as that which appears with an only very slight deflection of a flexible carrying element in a maximum angle range of only approximately 0 to 3°, with respect to the vertical, triggers a motor drive in the corresponding direction. The drive speed can be controlled as a function of the amount of force (lower speed with smaller force and greater speed with stronger force).

When using a flexible carrying element, such as a cable, the tension of the carrying element (cable tension) increases with an increasing load, which has an advantageous influence on the effect of the carrying element on the path-free force recorder, which it is next to. So that the system responds, large deflection angles of the carrying element, with respect to the vertical, are not necessary.

Here, it is particularly advantageous if the manipulation force is not converted into speed according to a linear curve, but rather according to a progressive curve. In this way, a slow start and a soft braking are attained and swings during starting and braking are avoided.

Even with a relatively large load, a relatively small, essentially horizontally acting manipulation force, which can thus be applied manually by one operator, very simply and without a special force effort, is advantageously sufficient. Also, a position-exact stop is readily possible since upon reaching the desired position, the motor drive immediately comes to a standstill by merely letting go, because the manipulation force becomes zero.

The invention under consideration is suitable for a one-axle model of crane runways, but preferably for two-axle crane runways. With the two-axle model, it is possible, in accordance with the invention, to control two drives, correlated with the two coordinate directions in one plane (X, Y), individually or simultaneously, so that by overlapping the drives all arbitrary movements in directions inclined with respect to the coordinate axes are possible, in that the carrying element is also acted on with force or is precisely deflected in the individual, desired direction of movement.

Moreover, a boom, which is held so that it can swivel around a vertical axis in a certain angle range, can be correlated with a motor drive device, which can be steered as a function of the force that acts on the carrying element in an essentially horizontal direction, and that can be applied manually and recorded by means of a sensor device.

On the basis of a very smooth mode of operation attained by the invention, this system is suitable in particular for use in combination with so-called weight balances. The load-lifting device is thereby designed in such a way that the practically "suspended" load, which is hanging on the carrying element, can be raised or lowered by a slight force, which is manually applied in a vertical direction. By combination with the invention under consideration, it is thus possible to manipulate the suspended load, independent of its weight, by very slight forces and arbitrarily in space—that is, it can be moved vertically and/or horizontally. Such a combined embodiment can therefore be designated as a "three-coordinate balancer" or a "space balancer."

Other advantageous development features of the invention are contained in the subclaims and the following description.

Figure 4:
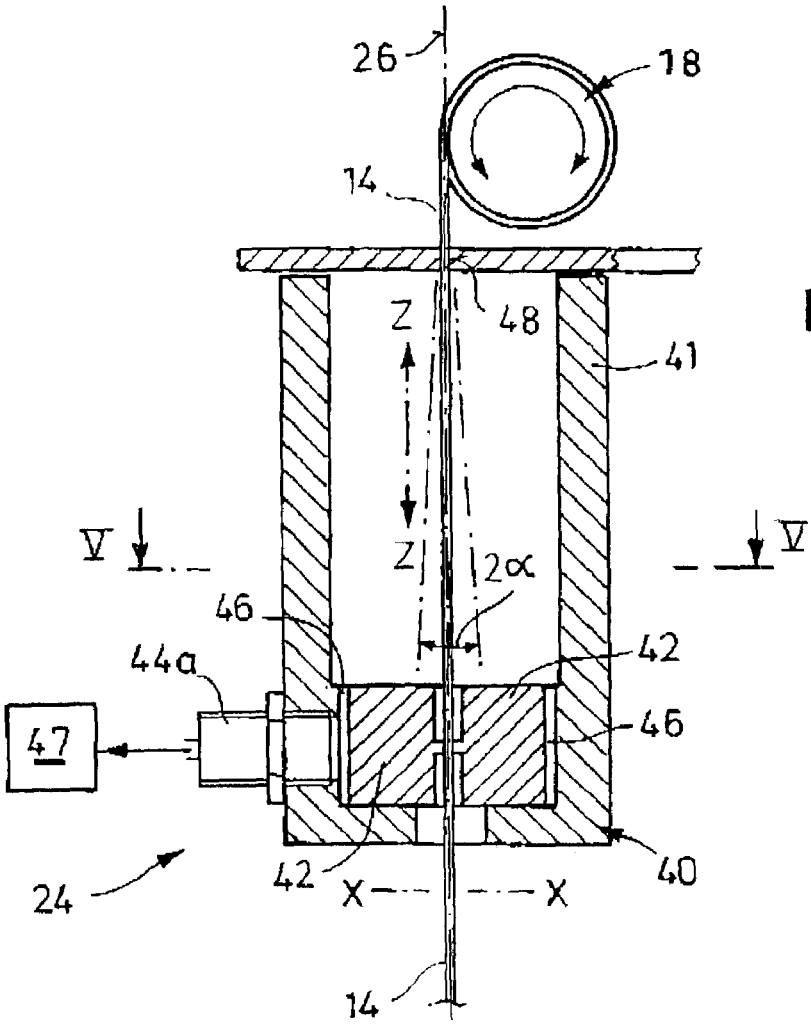
Figure 5:
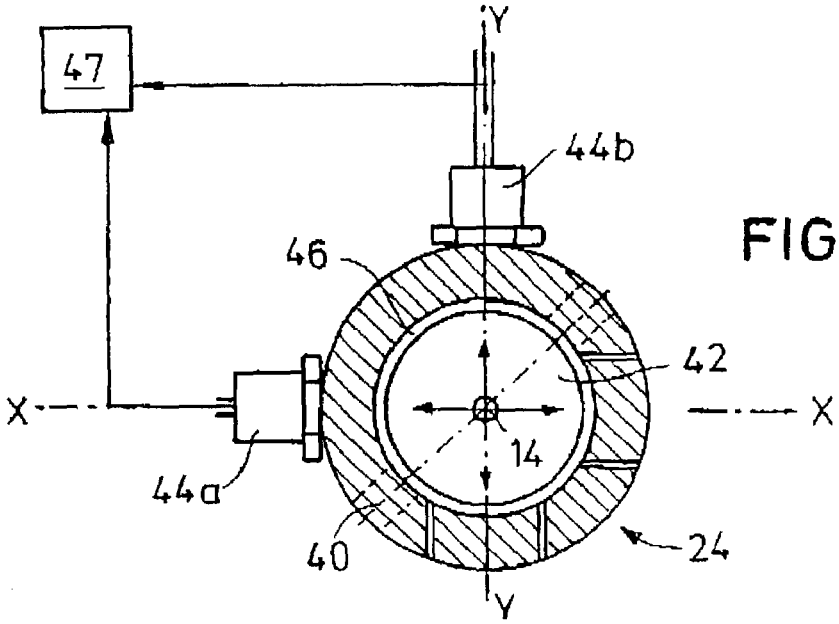
Figure 6:
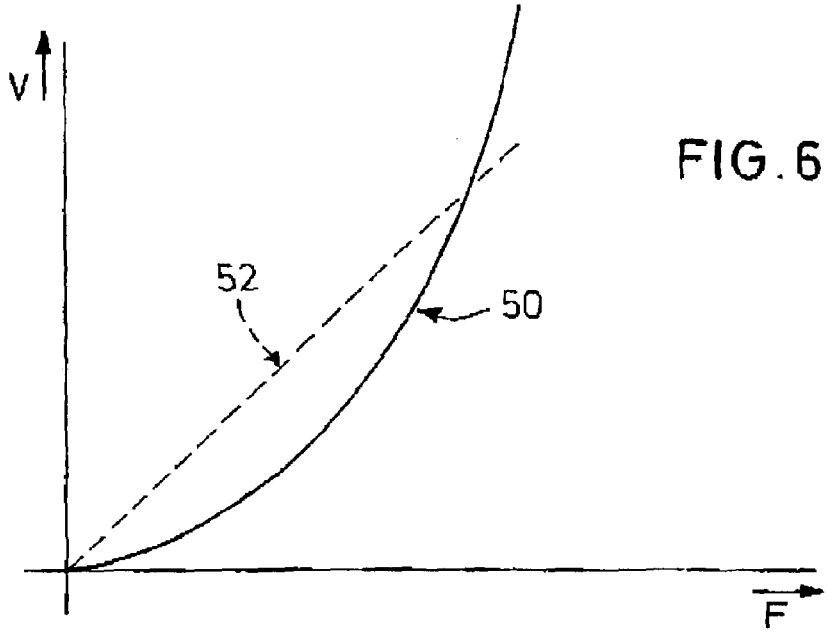
Figure 7:
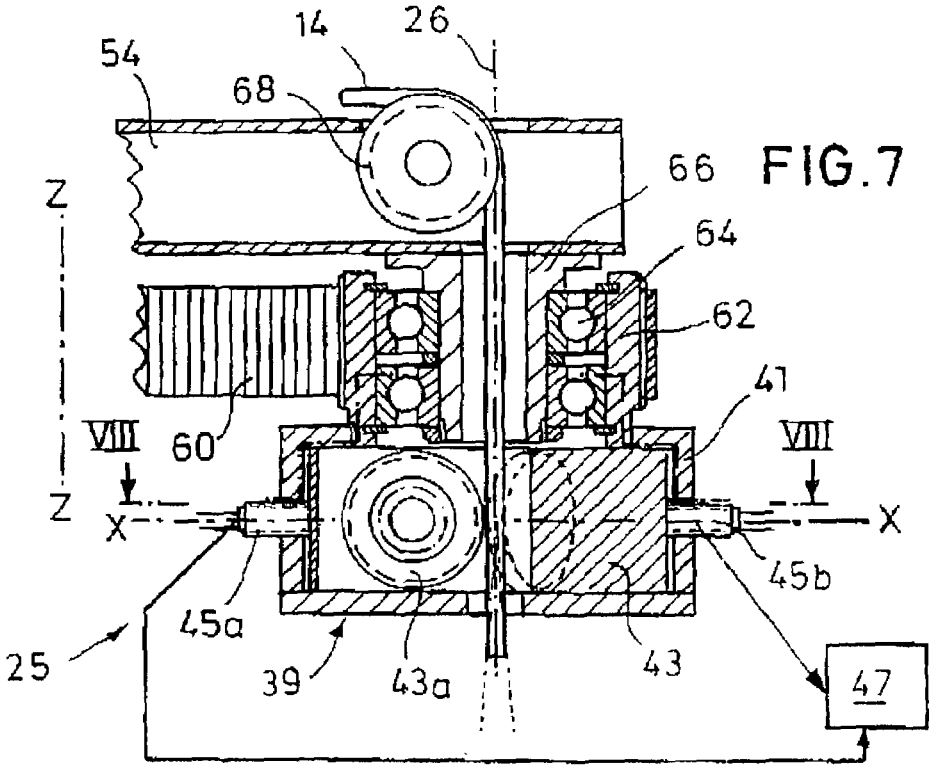

The invention will now be more precisely explained with the aid of preferred exemplified embodiments, which are illustrated in the drawings. The figures show the following:

FIG. 1, a simplified perspective representation of a crane runway with a load-lifting device (traveling crab), which moves along a horizontal movement axis X—X;

FIG. 2, a crane runway in a model with a load-lifting device, which moves in the direction of two coordinate axes X—X and Y—Y over a horizontal area;

FIG. 3, an enlarged side view in the arrow direction III, according to FIG. 2, with an additional representation of a load and an operator;

FIG. 4, a vertical section through the main component of a sensor device of the control system;

FIG. 5, a horizontal section in plane V—V, according to FIG. 4;

FIG. 6, a force/speed diagram for a preferred embodiment with a progressive conversion of force into speed;

FIG. 7, analogous to FIG. 4, a vertical section through the main component of a first model of the sensor device of a control system in accordance with the invention.

Figure 10:
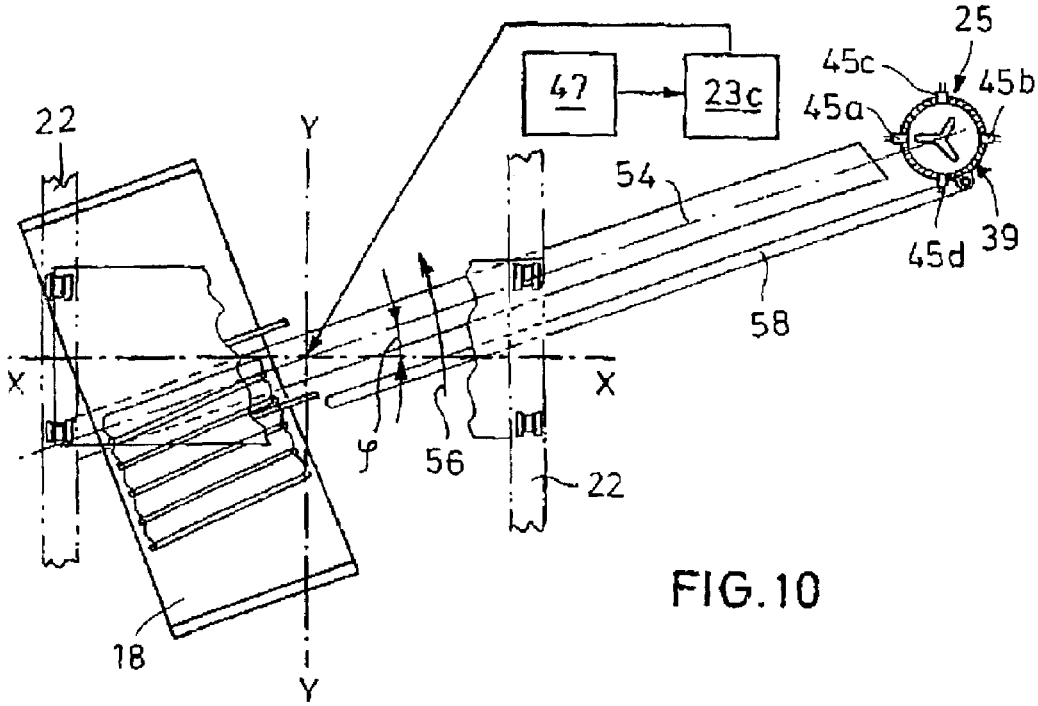
Figure 11:
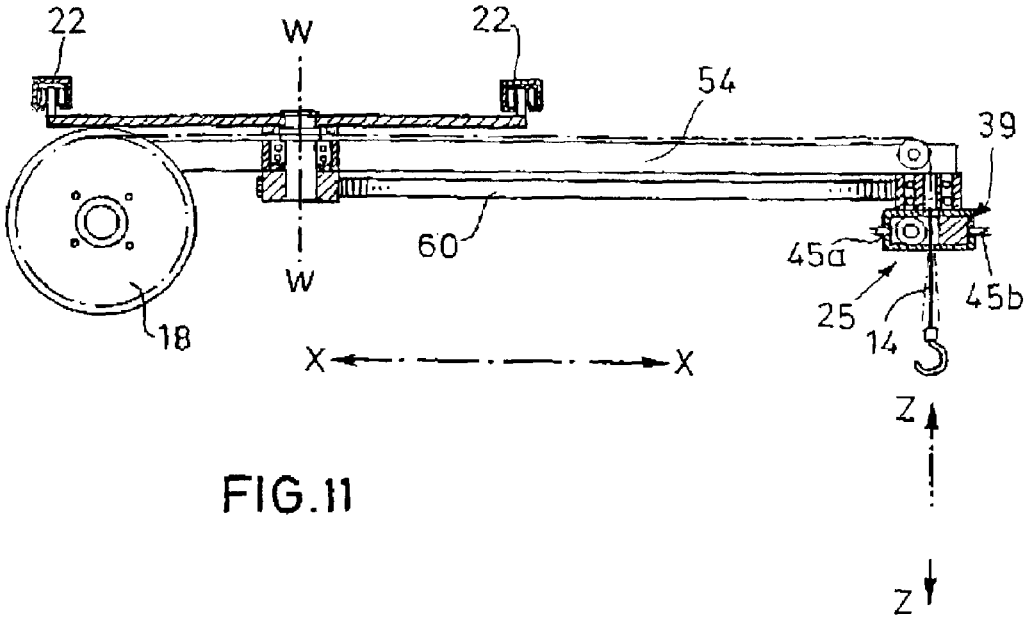
Figure 12:
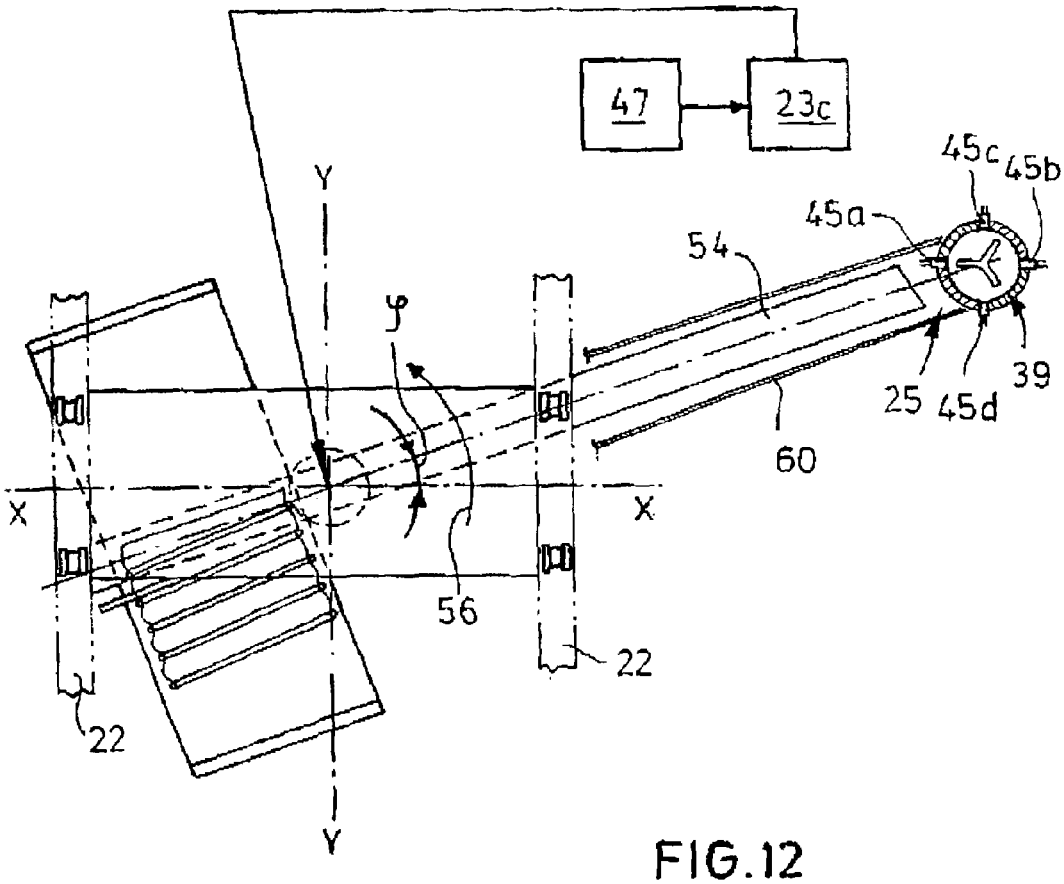
Figure 13:
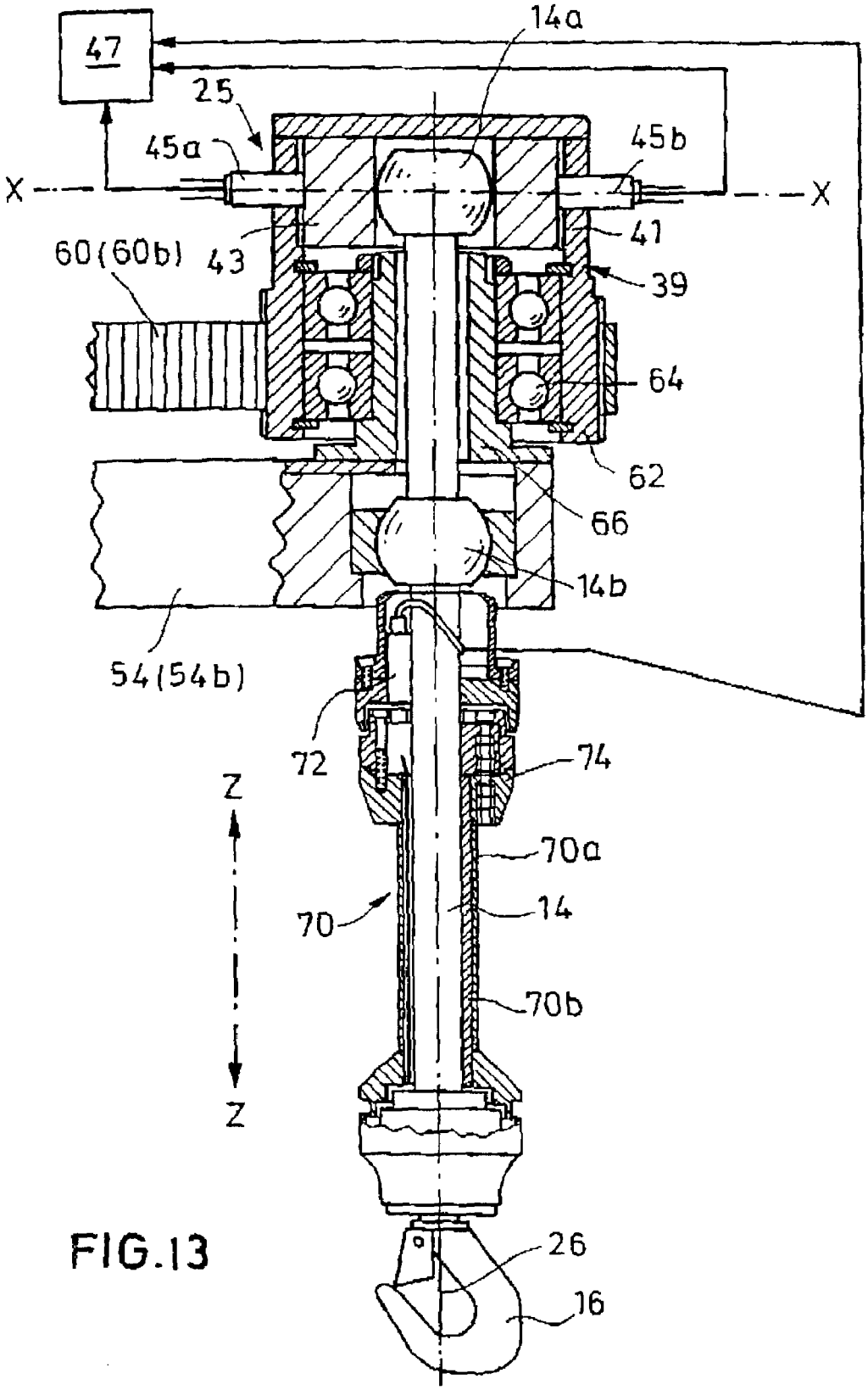
Figure 14:
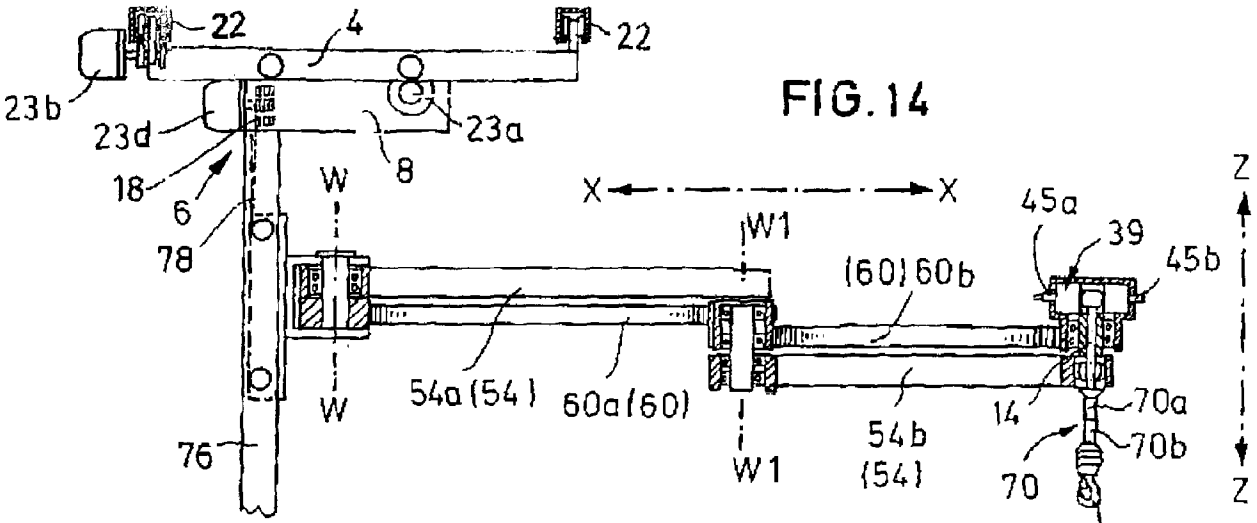
Figure 15:
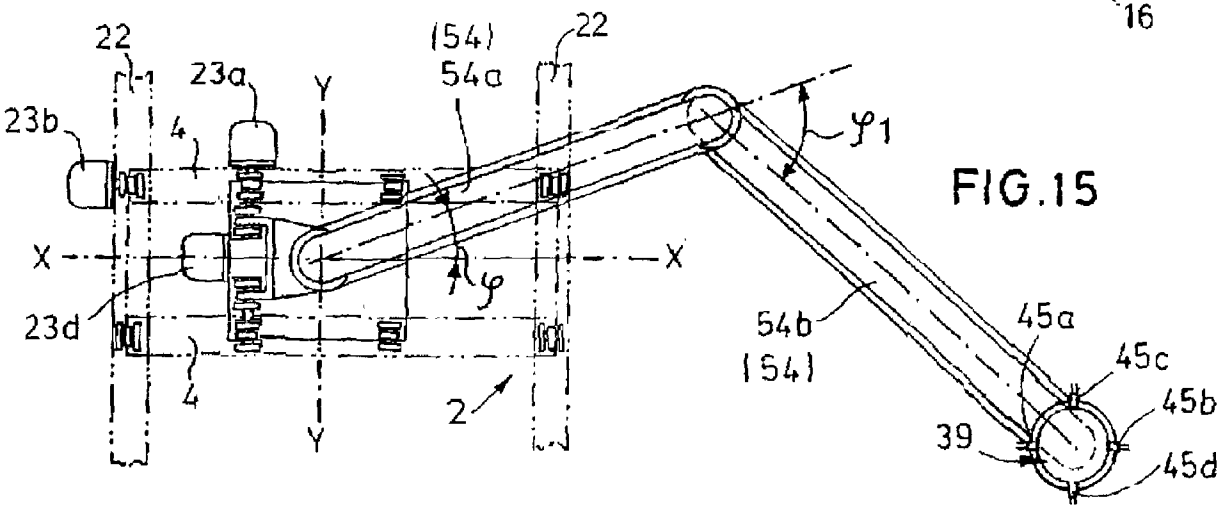
Figure 16:
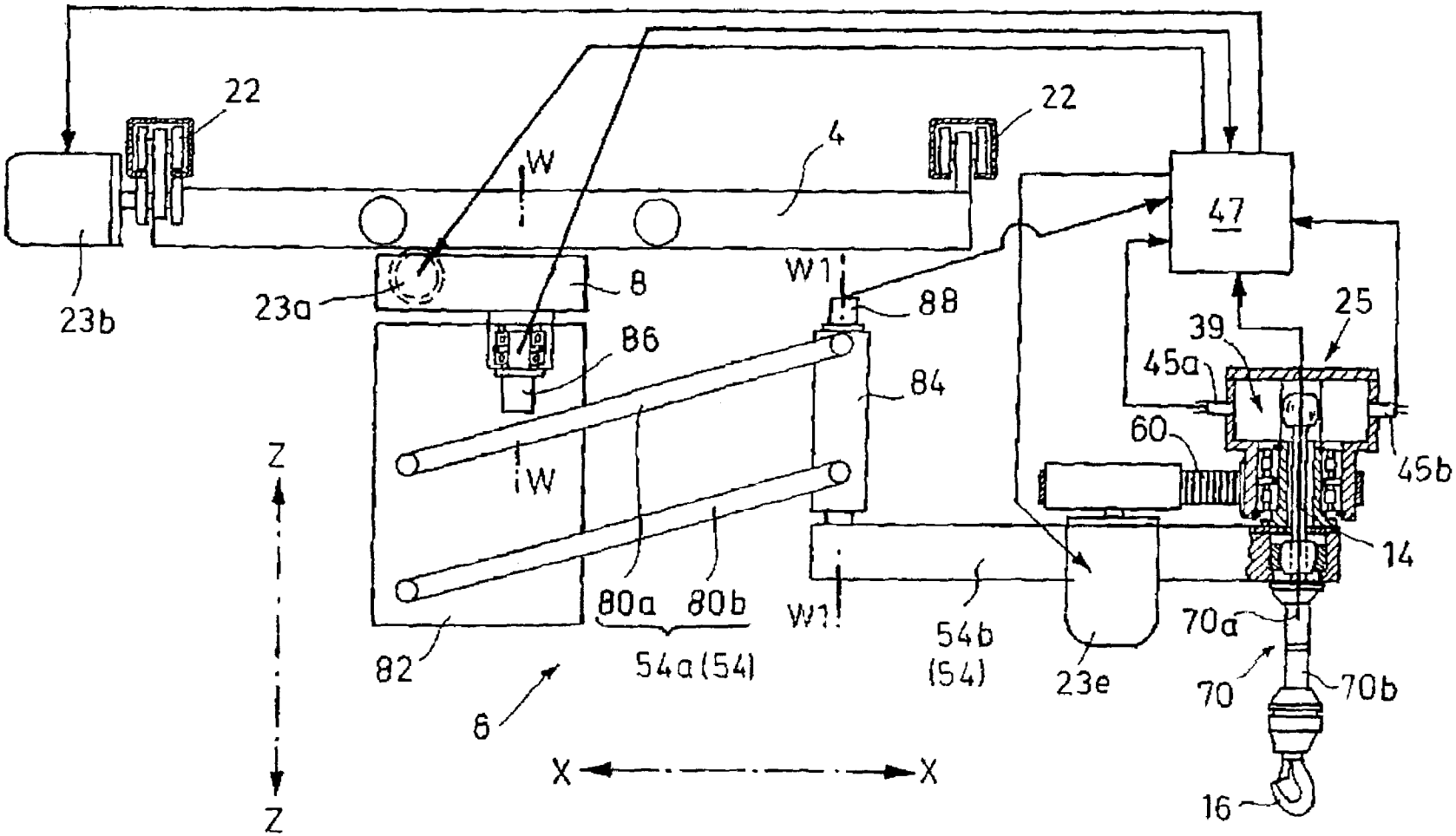
Figure 17:
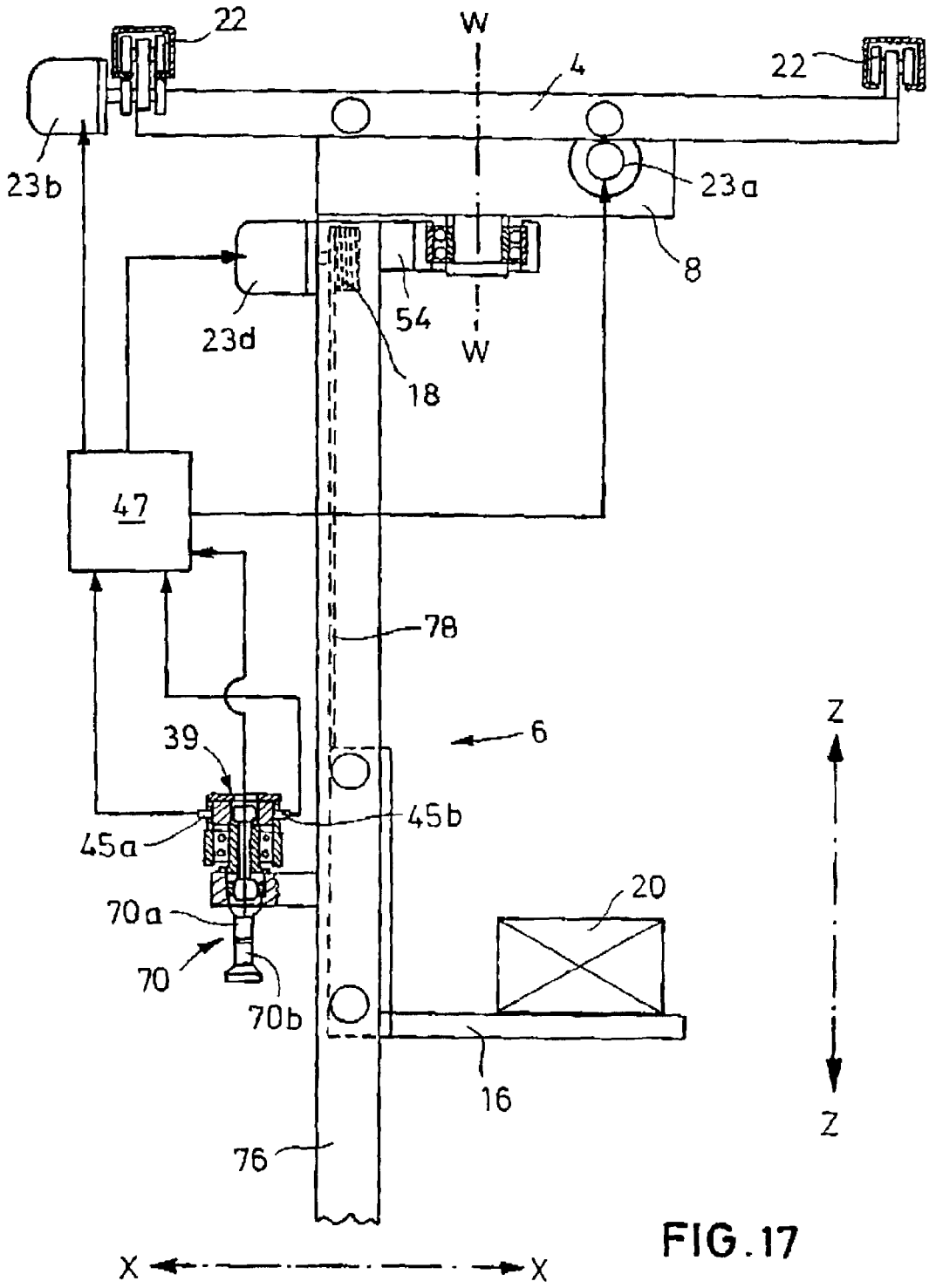

FIG. 8, analogous to FIG. 5, a horizontal section in plane VIII—VIII, in accordance with FIG. 7;

FIG. 9, a lateral section through a first model of a boom of a control system, in accordance with the invention, which can rotate around at least one vertical axis;

FIG. 10, a top view of the boom shown in FIG. 9;

FIG. 11, a lateral section through a second model of a boom of a control system, in accordance with the invention, which can rotate around at least one vertical axis;

FIG. 12, a top view of the boom shown in FIG. 11;

FIG. 13, analogous to FIG. 7, a vertical section through the main component of a second model of the sensor device of a control system, in accordance with the invention;

FIG. 14, a lateral section through a third model of a boom of a sensor system, in accordance with the invention, which can rotate around at least one vertical axis;

FIG. 15, a top view of the boom shown in FIG. 14;

FIG. 16, a lateral section through a fourth model of a boom of a control system, in accordance with the invention, which can rotate around at least one vertical axis;

FIG. 17, a lateral section through a fifth model of a boom of a control system, in accordance with the invention, which can rotate around at least one vertical axis.

In the various drawings, the same parts are always provided with the same reference symbols, so that they are described only once, as a rule.

FIG. 1 first shows, by way of example, a crane runway 1 in a model of a one-track runway. Here, a track construction 2 is provided with a track 4, which extends horizontally and particularly in a straight line, on which a load-lifting device 6, particularly a so-called traveling crab 8, is conducted back and forth in the direction of a horizontal coordinate axis X—X. The track construction 2 is affixed via a holding element 10 on a building roof and/or special stationary carrier 12 (see FIG. 2), which is not depicted.

In the first exemplified embodiments, described in the following, the load-lifting device 6 has a flexible carrying element 14, which can be rolled and thus accordingly swung and which is shown here, by way of example, as a carrier cable (steel cable), but it can also be formed, for example, from a chain. On its one lower end, the carrying element 14 has a load-holding device 16—in the simplest case, for example, a hook or the like; it can also be a suction device, a gripping device, pallet forks, and the like. At the other end, a motor winding and unwinding device 18 is connected with the carrying element 14 (see FIG. 4). Thus, the load-holding device 16 with a load 20 (FIG. 3) can be moved in a vertical spatial direction Z—Z—that is, it can be raised or lowered—via the carrying element 14.

FIG. 2 shows the crane runway 1, by way of example, in a second model, as a traveling crane. The track construction 2 thereby consists of, on the one hand, the track 4, guiding the load-lifting device 6 in the coordinate direction X—X, and on the other hand other tracks 22, whereby these other tracks 22 are fixed stationary over the holding element 10, and wherein the track 4 is conducted so that it moves back and forth in a second horizontal coordinate direction Y—Y, on tracks 22. The two coordinate directions X—X and Y—Y are situated vertically with respect to one another and form a plane X-Y. Thus, the load-lifting device 6 can be arbitrarily moved over the entire area covered by the track construction 2.

The load-lifting device 6 is correlated with at least one motor drive device 23*a* for its movements in the direction X—X and/or Y—Y (FIG. 1). In the preferred embodiment according to FIG. 2, a corresponding drive device 23*a* and 23*b* is provided for the two movement directions X—X and Y-Y1; this, however, is only schematically (in block representation) shown in the figures—including the corresponding acting connections (in the form of undesignated arrows). To steer each drive device 23*a*, 23*b*, a special control system is provided in these exemplified embodiments, wherein each drive device 23*a*, 23*b* can be steered as a function of a deflection of the carrying element 14, which is forced, proceeding from the vertical alignment into the position at rest, influenced by gravity and automatically adjusted. To this end, the system has a special sensor device 24—reference is made, in particular, to FIGS. 4 and 5. Deflections of the carrying element 14, relative to the vertical 26 can be very sensitively recorded with this sensor device 24. The sensor device 24 then produces signals to control the individual drive device 23*a*, 3*b* of the load-lifting device 6, as a function of the direction and preferably also the degree (angle measurement). With respect to the production of the control signals, the sensor device 24 is preferably designed in such a way that a movement of the load-lifting device 6 is brought about in a certain coordinate direction—for example, ±X and/or ±Y, by a deflection of the carrying element 14, which is approximately in the same direction and essentially corresponds to the desired movement direction.

This is illustrated in FIG. 3, by way of example, with the aid of the depicted arrows. If, for example, the operator 28 manually acts on the carrying element 14 by means of the load 20 and/or the load-holding device 16 in the direction of the arrow 30, with a manipulation force F and in this way, corresponding to the direction of movement −Y, deflects into a slightly inclined orientation 32 via an angle α from the vertical 26, then the control signals produced by the sensor device 24 have an effect on the drive of the load-lifting device 6, precisely in the direction of movement −Y, that is, in the direction of the arrow 34. Correspondingly, a reverse force F or deflection shown by the arrow of movement 36 would have an effect on a drive in the direction of the arrow 38, that is, in the direction of movement +Y. Something similar is also valid for the movement axis X—X and also for movements in both axes, that is, for overlapped movements, inclined with respect to the coordinate axes.

In accordance with FIGS. 4 and 5, the sensor device 24 has a measurement unit 40 with a housing 41. In the (comparison) example shown, in which an indirect force recording is provided via a force-proportional deflection of the carrying element 14, the measurement unit 40 has, on the one hand, a deflection body 42, connected with the carrying element 14, and on the other hand at least one distance sensor 44*a*, 44*b*, correlated with the individual coordinate axes X—X or Y—Y, and thus with the corresponding drive device 23*a*, 23*b*. The deflection body 42 sits on the carrying element 14 so that it can move longitudinally in such a way that, on the one hand, the carrying element 14 can move in the direction of the vertical axis Z—Z, relative to the deflection body 42, which is essentially held stationary in this axis direction, for the purpose of raising or lowering the load or the load-holding device 16; on the other hand, the deflection body 42 is moved along, with deflections of the carrying element 14, relative to the distance sensors 44*a*, 44*b*, to change the distance, which can be recorded for the creation of the control signals. Each distance sensor 44*a*, 44*b* is, in this respect, held horizontal, at a certain distance, next to the deflection body 42.

For the model having the possibility of movement of the load-lifting device 6 in two coordinate directions X and Y, the measurement unit 40 has—as shown—two distance sensors 44*a*, 44*b* situated, in accordance with the two coordinate axes, at an angle of 90° with respect to one another. The deflection body 42 is appropriately designed as a circular-cylindrical body and is located in a hollow-cylindrical holding housing 41, wherein the sensors 44*a*, 44*b* are held within the walls of this holding housing 41. The deflection body 42 is, in this way, surrounded by a uniform annular gap 46, in its position at rest (carrying element 14, oriented exactly vertical). The inside diameter of this annular gap 46 is recorded, with measurement technology, by the sensors 44*a*, 44*b*, then converted into control signals. To this end, the distance sensors 44*a*, 44*b* are connected with an only schematically shown electronic evaluation unit 47, which in turn creates the control signals for the drive devices 23*a*, 3*b*, with the aid of the pertinent initial sensor signals.

In accordance with FIG. 4, the measurement unit 40 has a stationary guide 48 for the carrying element 14 in the upper area of the holding housing 41, in order to support the carrying element 14, laterally, with respect to deflections. The guide 48 can be formed by a lead-in opening, which has such an opening cross section, adapted to the cross section of the carrying element 14, that the carrying element 14, which moves relative to the vertical axis, is conducted in a stationary manner, in this fixed point, relative to the horizontal axis. This fixed point thus forms swinging axes for the deflections of the section of the carrying element 14, which lies (hangs) beneath.

Each drive device 23*a*, 23*b* is preferably designed as a speed-controlled motor, in particular with a traveling mechanism acting on the carrying track construction 2. It can advantageously be, for example, a wheel and disk drive. Of course, alternatively, gearwheel drives or synchronous belt drives can also be provided.

As can be deduced from the diagram in FIG. 6, the manipulation force F or the deflection of the carrying element resulting therefrom is preferably converted into the drive speed v, in accordance with a progressive curve 50. This is attained with a corresponding design or programming of the electronic evaluation unit 47, which makes possible an adaptation of the curve and thus the response behavior of the system to different load-lifting tasks. The advantages of this progressive curve 50 with a flat initial rise include, above all, a soft, extensively jerk-free starting and stopping of the load-lifting device 6 and the avoidance of swings during starting and braking, wherein nevertheless even high speeds are possible. If, on the other hand, the conversion took place with the aid of a linear curve 52, indicated with a broken line in FIG. 6, then a jerky start/braking, which produces swings back and forth, would result from this. A correspondingly flat rise of a linear curve would have, above all, the disadvantage that even with a high force F, only a relatively low speed could be produced, which would then lead to the system not reacting with slight (short) deflections.

The system is preferably used in combination with a so-called weight balancer. Preferably, the carrying element 14 is thereby correlated with a torque-controlled drive (not shown in the drawing), for its vertical movements in the axis direction Z—Z, which, depending on the load, produces a constant torque in such a way that the load 20 is held statically in the vertical direction in any position—that is, it practically hovers. Slight, manually applied forces (load changes), acting vertically upwards or downwards, automatically bring about a raising or a lowering of the load 20 because of the constant torque. This results in a very simple and smooth manipulation of the supposedly hovering load in space by very slight forces, even in the vertical direction.

A model of a system for controlling a load-lifting device 6, in accordance with the invention, is first shown, by way of example, in FIGS. 7 and 8. Instead of the sensor 24 described above, which is based on the measurement of a certain distance, a sensor device 25 is provided, which is designed and situated, relative to the carrying element 14, in such a way that the force F, which is applied for the control of the system, in particular a force F that strikes in the area of a load-holding device 16, located on the free, lower end of the carrying element 14, is recorded path-free.

As in the previously shown example, the sensor device 25 has, in turn, a measurement unit, which is designated here with the reference symbol 39. The measurement unit 39 consists of a housing 41, in which, however, there is no deflection body 42 here, but rather a measurement body 43, connected with the carrying element 14, and at least one force recorder 45*a*, 45*b*, 45*c*, 45*d* (in the model shown, two), correlated with the individual coordinate axis X—X, Y—Y or the pertinent drive device 23*a*, 23*b*. Each of the force recorders 45*a*, 45*b*, 45*c*, 45*d* is thereby in permanent contact with the measurement body 43. The carrying element 14 is, in turn, a flexible carrying element, such as a cable, which can be wound and which runs over three guide rollers 43*a*, 43*b*, 43*c* of the measurement body 43. The measurement body 43 is located, stationary, in the direction of the vertical axis Z—Z, and for the purpose of raising or lowering a load 20, the carrying element 14 can be moved through a centric opening in the measurement body 43 is formed by the guide rollers 43*a*, 43*b*, 43*c*, which are staggered by 120° with respect to one another, and can move longitudinally in the direction of the vertical axis Z—Z, relative to the measurement body 43.

The additional details of the mode of operation of the sensor device 25 (for example, the response of the sensor device 25 with a deflection of the carrying element 14, relative to the vertical axis 26, the magnitude and direction of the signals produced in the control device 47 for the drive devices 23*a*, 23*b*, the type of drive devices 23*a*, 23*b* used, the possibility of the construction of the load-lifting device 6 as a weight balancer, nonlinear curve, etc.) agree with the models of the control system described in the preceding. For that reason, measurement device 40 and measurement device 39 are indicated as alternatives in the block representation of FIG. 1. However, due to the fact that the force recorder 45*a*, 45*b*, 45*c*, 45*d* of the measurement device 39, in accordance with the invention, is essentially located right next to the measurement body 43, without any gaps, a load-dependent manipulation force for the production of a control signal is not needed, on the one hand, and the system ensures a constantly high functional reliability, even under more adverse environmental conditions, on the other hand. The path-free force recording thus ensures an increased reliability of the system, in that there is a lower soiling risk for the sensor device 25 and thus less of a possibility for the long-term negative influence on the sensitivity than when the force recorder(s) 44*a*, 44*b* is/are held, next to a deflection body 42, at a certain distance (annular gap 46).

As a path-less force recorder 45*a*, 45*b*, 45*c*, 45*d*, the sensor device 25 can advantageously have at least one wire strain gauge-force recorder. Wire strain gauge (DMS)-force recorders are the most important representatives of the electrical force recorders. In the simplest case, four wire strain (DMS) gauges are cemented on an elastic hollow cylinder to produce such a wire strain (DMS) gauge-recorder. If the cylinder is compressed by a load, the resistances of the DMS are changed. The four DMS are interconnected in a Wheatstone bridge. Instead of a tube-shaped (hollow-cylindrical) deformation body, rod-like deformation bodies can also be used. What is particularly advantageous is that DMS-force recorders are suitable for static and dynamic measurements and for nominal forces in the range of 5 N to 20 MN.

Furthermore, as force recorders 45*a*, 45*b*, 45*c*, 45*d*, the sensor device 25 can have at least one magnetoelastic force recorder. The mode of action of such a magnetoelastic force recorder is based on the magnetoelastic effect of ferromagnetic materials, wherein their permeability changes with the effect of a certain force. The resulting inductance change of a coil with a core made of the ferromagnetic material, on which the force acts, directly changes the current that flows through the coil. Since the current can be measured directly, no measurement reinforcers are required; this, in particular, predestines such force recorders for use under robust operating conditions.

As path-less force recorders 45*a*, 45*b*, 45*c*, 45*d*, piezoelectric force recorders can also be advantageously used in the sensor device 25. The basis for these piezoelectric force recorders is the piezoelectric effect, according to which charges appear on certain crystals if they are mechanically stressed. Quartz crystals have the most consistent characteristics and the best insulation, making them most suitable for measurement purposes. In a piezoelectric force recorder (pressure gauge), the force mechanically acts on two piezoelectric crystal elements, which lie behind one another, but they are electrically parallel. In this way, the required insulation of a middle metal electrode, situated between the two piezoelectric crystal elements with respect to a metal housing and serving as the second electrode, can be attained, without further expense, only by means of the two piezoelectric crystal elements. The initial (signal) magnitude of a piezoelectric force recorder is a charge, which is converted into a corresponding voltage by a charge reinforcer. The advantage of using this force recorder is revealed mainly with quick dynamic measurements, in which the important aspects are the small structural size and the insensitivity toward temperature fluctuations. Piezoelectric force recorders also have a very good resolution and low measurement unreliability.

Finally, there is also the possibility that, as force recorders 45*a*, 45*b*, 45*c*, 45*d*, the sensor device 25 has at least one fiber-optical force recorder. With such a recorder, either the recording or the transmission of the measurement value takes place by means of a fiber optical waveguide. Depending on the function of the fibers, one distinguishes between intrinsic and extrinsic fiber-optical recorders. In an intrinsic fiber-optical recorder, the fibers themselves are used as the sensitive element, in that the conversion of the measurement value (force F) into an optical signal takes place. For example, with a lateral force effect on an optical fiber, wrapped with a thin wire, a loss of the conducted-through light current arises, which can be recorded by evaluation electronics via photodetectors. In an extrinsic, fiber-optical sensor, the primary purpose is the transmission of the measurement value from the measurement site to an evaluation site, in as disturbance free a manner as possible. The conversion of the measurement variable into an optical signal takes place at the measurement site, outside the fiber—for example, by means of integrated-optical or microoptical components. Thus, the force to be measured can control the opening width of a diaphragm for a light current, whereas another part of the light current remains unchanged, as a reference signal. The evaluation electronics then compares the two light currents and produces, therefrom, a force indication in a path-neutral manner. The use of fiber-optical recorders is particularly suitable if measurement-technologically "difficult" environmental conditions prevail, for example, strong electrical or magnetic disturbance fields, high temperatures, or explosive or corrosive atmospheres.

Two advantageous embodiments of the invention are shown in FIGS. 9 and 10, as well as 11 and 12. For the two embodiments, it is characteristic that the system for controlling the load-lifting device in accordance with the invention has a boom 54, which is supported so that it can swivel around a vertical axis W—W (FIGS. 9 and 11), around an angle ϕ (FIGS. 10 and 12).

As schematically indicated in FIGS. 10 and 12, the boom 54 can be correlated with a motor drive device 23*c*, which, however, is not necessarily required and which can be controlled as a function of a force F that acts on the carrying element 14 in an essentially horizontal direction and that is applied manually and can be recorded by means of the sensor device 25. Also, a drive device 23*c* can, as with other drive devices 23*a*, 23*b*, be advantageously designed as a servomotor, in particular with a wheel and disk drive, gearwheel drive, or synchronous belt drive.

The sensor device 25 can thereby be advantageously designed in such a way that a movement of the load-lifting device 6 in the direction of deflection by the angle ϕ (arrow with the reference symbol 56) is brought about by a force F, which is applied approximately in the same desired direction of movement.

Also, the drive speed v of the drive device 23*c* can in turn be controlled—as shown above—as a function of the magnitude of the individually applied force F—advantageously, with the aid of a progressive curve 50 with a flat initial rise, as FIG. 6 shows.

As a result of the fact that the measurement unit 39 has four path-free sensors 45*a*, 45*b*, 45*c*, 45*d*, which are situated in accordance with the two coordinate axes X—X, Y—Y, at an angle of 90° with respect to one another, control signals can be produced both for the linear drive devices 23*a*, 23*b* as well as for the drive device 23*c* to swivel the boom 54 in the electronic evaluation unit 47, simultaneously with the aid of the individual initial sensor signals, depending on the effect direction of the applied force F in the four quadrants formed by the coordinate axes X—X, Y—Y.

Here, it is of particular advantage if the housing 41 of the measurement device 39 can rotate with respect to the measurement body 43, with the measurement body 43 and the housing 41 being affixed to the boom 54 in such a way that when the boom 54 is swiveled by the angle ϕ around the vertical axis W—W, the housing 41 is rotated by the same angle in such a way that the housing 41 retains its angle orientation with the path-less force recorders 45*a*, 45*b*, 45*c*, 45*d*, relative to the track construction 2.

This conformal movement of the housing 41 means that with each angle ϕ by which the boom 54 is swiveled, a simple signal evaluation by the electronic evaluation unit 47 is possible, since the pair of force recorders 45*a*, 45*b*, and 45*c*, 45*d* are always oriented at the same angle, with respect to the horizontal main axes X—X, Y—Y of the space—for example, as is particularly clear from FIGS. 10 and 12, on the one hand parallel to the axis, and on the other hand at right angles to the axes X—X, Y—Y.

For the movement of the housing 41, a coupling rod 58 (FIGS. 9 and 10) that is articulated so that it can rotate at one end on the boom 54 and on the other end on the housing 41, or also a corresponding synchronous belt drive 60 (FIGS. 11 and 12), a chain drive, or the like, can be used. Such a synchronous belt drive 60 can, moreover, also be deduced from the enlarged representation in FIG. 7. It runs parallel to the boom 54 above the sensor device 25, whose housing 41 has an axial, tube-shaped extension 62 in the direction of the boom 54, which is encompassed by the synchronous belt drive 60 and is held, by means of rolling bearings 64, on a likewise tube-shaped projection piece 66 on the free end of the boom 54. The carrying element 14 is guided through the inside of the projection piece 66 over a deflection roller 68.

In the embodiments of a system for controlling a load-lifting device 6 in accordance with the invention and shown in FIGS. 13 to 17, the holding element 14 is not designed as a cable, but rather rigidly formed as a rod, in contrast to the models described in the preceding. Moreover, the basic structure of the measurement unit 39 is essentially the same as the model described above. To this extent, reference is made to the pertinent explanations above. Differences with the above model, however, still exist in the support of the rigid holding element 14 and in a special design of the operating grip 70.

The holding element 14 is not conducted over guide rollers 43*a*, 43*b*, 43*c*, but rather preferably has—as shown—two spherical thickenings 14*a*, 14*b* are used for its support in the measurement body 43 and in the boom 54.

The operating grip 70, designed in the shape of a tube, encompasses the holding element 14 and has two sleeve-like metal parts 70*a*, 70*b*, insulated from one another, as can also be clearly seen from FIGS. 14, 16, and 17. The metal parts 70*a*, 70*b* are electrically bypassed by the manual grip of the operator 28, wherein a current circuit is closed, turning off a safety blocking that is switched on when the system is at rest.

The operating grip 70 is, moreover, also especially designed for the control of vertical movements of loads 20 hanging on the carrying element 14. A load 20 can be raised or lowered by small forces applied manually in the vertical direction 26. The recording of the force takes place thereby with a sensor 72, by means of which a distance change of a sliding sleeve 74, brought about by a vertical operating force, is detected, with a corresponding signal being emitted to the electronic control unit 47. As occurs in an analogous manner with the signals of the path-free sensors 45*a*, 45*b*, 45*c*, 45*d*, this signal can be converted there into a control signal for a drive device for the vertical movement of the load 20. Such drive devices are shown in FIGS. 14, 15, and 17 with the reference symbol 23*d*. FIGS. 13, 16, and 16 contain, by way of example, in the form of action arrows, an illustration of the described signal flow from the grip 70, especially from its sensor 72 to the electronic control unit 47, wherein FIG. 14, by way of example, in the form of an action arrow, also contains the illustration of the signal flow from the electronic control unit 47 to the vertical drive 23*d*. As was already mentioned, with such a combination with the invention under consideration, it is thus possible to manipulate the suspended load 20, independent of its weight, by very small forces arbitrarily in space—that is, it can be moved vertically and/or horizontally. In the representation shown in FIG. 13 (moreover, in FIGS. 14 and 16 also), a hook is provided as a load-holding device 16, which is found directly below the operating grip 70.

Another nondepicted execution possibility for the measurement device 39 consists of directly placing the sensor device 25, for the detection of the control forces F for the horizontal movement, in the operating grip 70. Preferably, four path-free sensors 45*a*, 45*b*, 45*c*, 45*d* can be designed for the quadrant-exact recording of the forces F by wire strain gauges.

In two different views, FIGS. 14 and 15 show, in turn, a control system in accordance with the invention—with a third model of the rotatable boom 54 and with the second model of the measurement unit 39. The representations in the drawing are selected analogous to those of the first model (FIGS. 9 and 10) and of the second model (FIGS. 11 and 12). The most substantial difference of the third model, compared to the variants described in the preceding, is that the boom 54 consists of two arms 54*a*, 54*b*, connected with one another in an articulated manner. As shown in FIGS. 10 and 12, with the boom 54, the first arm 54*a* can be swiveled around the vertical axis W—W at an angle $\phi$1 between arm 54*a* and the X—X axis; the second arm 54*b* can be swiveled around a vertical axis W1—W1 at an angle $\phi$1 between arm 54*b* and arm 54*a*. As in the first two models, when swiveling the two boom arms 54*a*, 54*b*, a subsequent mechanical movement of the sensor device 25 takes place in such a way that the path-less force recorders 45*a*, 45*b*, 45*c*, 45*d* retain their angle orientation, relative to the track construction 2 or to the axes of the X-Y plane. In particular, a synchronous belt drive 60 is provided for the subsequent mechanical movement, as with the second model of the boom 54, wherein, here, two synchronous belt drives 60*a*, 60*b*—one for each arm 54*a*, 54*b* of the boom 54—are used.

The boom 54 is conducted in a manner such that it can move vertically, on a rod 76, which is connected in a stationary manner with the traveling crab 8, wherein for a movement in the Z—Z direction, a special drive 23*d* can be provided, which, as already mentioned, can be controlled and—for example, similar to the representation in FIG. 4 for the carrying element 14, which is flexible there—can be connected with a motor winding and unwinding device 18 for a cable 78. (All existing drive devices 23*a*, 23*b*, and 23*d* are not only shown schematically but also representationally in FIGS. 14 and 15, as well as also in the other figures. Special drives 23*c* for the angle adjustment of the boom 54 or its arms 54*a*, 54*b* are not provided, since this adjustment is done manually.)

In the model of a control system in accordance with the invention, shown in FIG. 16, the boom 54 (in a fourth model) is also formed from two arms 54*a*, 54*b*. The vertical mobility of the load 20, however, is attained here in that the first arm 54*a* can swivel not only around the vertical axis W—W in a horizontal direction, but also in a vertical direction. For this purpose, the arm 54*a* consists of two swivel levers 80*a*, 80*b* that are located parallel to one another, and which are articulated so they can move by rotating on one end with a holding part 82 connected with the traveling crab 8, and on the other end with a holding part 84 connected with the second arm 54*b*.

In contrast to the previously shown models of the system of the invention, it is not a mechanical but rather an electrical subsequent movement of the measurement device 39 or sensor device 25, following the movement of the boom 54 in the X-Y plane, which is implemented and which can be designated as "subsequent movement via an electrical shaft." Incremental swing-angle measurement disks (encoder) 86,88 are provided in the individual hinge points as devices for the creation of signals for the angles $\Psi$, $\Psi_1$ around which the boom arms 54*a*, 54*b* are swiveled; these measurement disks are coaxially arranged with respect to the swing axes W—W, W1—W1 of the boom arms 54*a*, 54*b*, which run vertically. The signals corresponding to the swing angles $\Psi$, $\Psi_1$ of the arms 54*a*, 54*b* are conducted to the electronic evaluation unit 47 where, by addition or subtraction, a resulting angle value is calculated for an actuator 23*e* for the subsequent movement of the path-less sensors 45*a*, 45*b*, 45*c*, 45*d*. This actuator 23*e* is preferably a stepping motor. The subsequent movement can take place advantageously, for example, via a synchronous belt drive 60, acting on the measurement unit 39, but also acting directly from the actuator 23*e* to the measurement unit 39.

The rotating hinges of the arms 54*a*, 54*b* on the vertical axes W—W, W1—W1 or the swivel levers 80*a*,80*b* on the horizontal axes (which are not designated more specifically) can be advantageously braked with the control of the traveling mechanisms 23*a*, 23*b*, so that while moving, an undesired spontaneous movement does not appear due to the inertia of masses of the aforementioned parts.

The activation of the blocking brakes, found on the rotating hinges, which bring about a rigid relative position of the arms 54*a*, 54*b*, or 80*a*, 80*b* can be advantageously implemented via the operating grip 70—particularly in that the operator 28, by manual grip, electrically bypasses the two sleeve-like metal parts 70*a*, 70*b*, insulated from one another as described above, wherein a corresponding activation circuit is closed. This is moreover possible with all exemplified embodiments, in which rotating hinges are provided.

Another model of a control system in accordance with the invention, with a boom 54, which can rotate on a vertical axis W—W, is shown in FIG. 17. This model has several features in common with the model shown in FIGS. 14 and 15, but the boom 54, which moves by rotating, is articulated via the axis W—W, directly on the traveling crab 8 and does not move by rotating on the vertical rod 76. Another vertical rod 76 is also present, on which, however, the load-holding device 16—in this case a fork—is vertically conducted. The vertical guiding and control of the load-holding device 16 occurs in the same way as with the model shown in FIGS. 14 and 15, via a vertical drive 23*d*, acting on a winding device 18 for a cable 78, which can be controlled, in turn, by the electronic evaluation unit 47. This receives its control signals, in turn, from the measurement device 39 with the path-less operating sensors 45*a*, 45*b*, 45*c*, 45*d* and for the operating grip 70, in which a sensor 72 for the vertical control is located. The operating grip 70 and the measurement device 39 also form one unit here, as with the models described in the preceding; however, this unit is affixed, in this case, to the vertical rod 76, which is articulated on the traveling crab 8 so that it moves by rotating. For this model also, a subsequent mechanical movement of the sensors 45*a*, 45*b*, 45*c*, 45*d* or a subsequent movement in accordance with the type of electrical shaft can be provided.

The invention is not limited to the exemplified models shown, but rather also includes all models that work in a similar manner in the sense of the invention. This concerns, in particular, the sensor device 25; here, any other embodiment with which forces can be recorded path-less on the carrying element 14 and which can be converted into control signals is also suitable. The provided drives 23*a*, 23*b*, 23*c* can be designed as electrical, pneumatic, and/or hydraulic motors. The electronic evaluation unit 47, shown only schematically in the examples, can preferably be integrated in a moveable part of the system, such as the traveling crab 8.

In addition, the specialist can amplify the control system, in accordance with the invention, with suitable technical measurements. With regard to such possibilities for the control of vertical movements of the load 20, reference is also made to the preceding models, in their full extent, particularly with respect to the object of German Utility Model Application DE 299 02 364.8.

Furthermore, the invention is not limited to the combination of features defined in claim 1, but rather can also be defined by any other combination of specific features of all individual features disclosed as a whole. Basically, this means that practically any individual feature of claim 1 can be left out or can be replaced by at least one individual feature, disclosed somewhere else in the application. In this respect, claim 1 is to be understood merely as a first formulation attempt for the invention.

REFERENCE SYMBOLS

1 Crane runway
2 Track construction
4 Track
6 Load-lifting device
8 Traveling crab
10 Holding elements
12 Carrier
14 Carrier element
14*a* Thickening on 14
14*b* Thickening on 14
16 Load-holding device
18 Unwinding device
20 Load
22 Track
23*a* Drive device (X—X)
23*b* Drive device (Y—Y)
23*c* Drive device for 54 (rotation in X-Y plane)
23*d* Drive device (Z—Z)
23*e* Drive device for 25 or 39
24 Sensor device
25 Sensor device
26 Vertical
28 Operator
30 Force effect direction
32 Orientation of 14 (deflected)
34 Movement direction of 14 at 30
36 Force-effect direction
38 Movement direction of 14 at 36
39 Measurement unit of 24
40 Measurement unit of 24
41 Housing of 39, 40
42 Deflection body of 40
43 Measurement body of 39
43*a* Guide roller in 43 for 14
43*b* Guide roller in 43 for 14
43*c* Guide roller in 43 for 14
44*a* Distance sensor in 40
44*b* Distance sensor in 40
45*a* Path-free sensor in 39
45*b* Path-free sensor in 39
45*c* Path-free sensor in 39
45*d* Path-free sensor in 39
46 Annular gap around 42
47 Electronic evaluation unit
48 Guide of 40
50 Curve v of F
52 Curve v of F
54 Boom
54*a* First boom arm
54*b* Second boom arm
56 Movement direction of 54
58 Coupling rod
60 Synchronous belt drive
60*a* First synchronous belt drive of 60
60*b* Second synchronous belt drive of 60
62 Extension of 41
64 Rolling bearings
70 Projection piece on 54
70*a* Deflection roller for 14
70 Operating grip
70*a* First metal part of 70
70*b* Second metal part of 70
72 Sensor in 70
74 Sliding sleeve
76 Rod
78 Cable
80*a* Swivel lever of 54*a*
80*b* Swivel lever of 54*a*
82 Holding part for 80*a*, 80*b* on 8
84 Holding part for 80*a*, 80*b* on 54*b*
86 Encoder (Axis W—W)
88 Encoder (Axis W1—W1)
F Force
v Speed
W—W Swivel axis of 54 or 54*a*
W1—W1 Swivel axis for 54*b*
X Spatial coordinates
X—X Spatial direction (horizontal)
X-Y Spatial plane (horizontal)
Y Spatial coordinate
Y—Y Spatial direction (horizontal)
Z Spatial coordinate
Z—Z Spatial direction (vertical)
a Deflection angle of 14
j Swivel angle of 54 or 54*a*
j1 Swivel angle of 54*b*

The invention claimed is:

1. A load-lifting apparatus with a control system for movements in a horizontal plane defined by coordinate axes (X-Y), comprising:

a load-lifting device having a carrying element oriented vertically (Z—Z) at least when in a position at rest and influenced by gravity;

a motor drive operatively associated with the carrying element to impart movement to the load lifting device in a substantially horizontal direction on at least one axis as a function of force (F) applied manually to the carrying element in a substantially horizontal direction;

a sensor device operatively associated with the motor drive and responsive to the manually applied force;

the sensor device having a housing with a measuring body in contact with the carrying element, and;

the sensor device having at least one force transducer allocated to a respective coordinate axis of the motor drive and in contact with the measuring body so as to detect path-free a horizontal movement imparted to the measuring body by the force manually applied to the carrying element, whereby the motor drive imparts the substantially horizontal movement to the load lifting device in response to the force manually applied to the carrying element.

2. System according to claim 1, characterized in that the carrying element is a flexible carrying element that can swing back and forth and can be wound, and which is oriented vertically (Z—Z) in its position at rest and influenced by gravity.

3. System according to claim 1, characterized by a supported boom operative to swivel around at least one vertical axis, by an angle.

4. System according to claim 3, characterized in that the boom comprises a first arm operative to swivel around a first vertical axis by a first angle, and a second arm operative to swivel around a second vertical axis, by a second angle.

5. System according to claim 3, characterized in that the boom is correlated with a motor drive device that can be controlled as a function of a force that acts on the carrying element in a substantially horizontal direction and can be recorded by means of the sensor device.

6. System according to claim 1, characterized in that the sensor device detects a force (F) that acts on the carrying element in the area of a load-holding device, which is located on a free lower end of the carrying element.

7. System according to claim 1, characterized in that the sensor device produces signals that can be detected in an electronic evaluation unit as a function of the direction, and also as a function of the magnitude of the force (F); with the electronic evaluation unit producing signals for controlling the motor drive of the load-lifting device.

8. System according to claim 1, characterized in that the sensor device is operative to cause a movement of the load-lifting device in a certain direction within a certain coordinate direction in response to a force, which is applied in the same movement direction.

9. System according to claim 1, characterized in that the drive speed of the motor drive is controlled as a function of the magnitude of the applied force.

10. The system as in claim 9, wherein the magnitude of increase in the drive speed becomes progressively greater in direct proportion to the magnitude of the applied force, so that an initial relatively low magnitude of increase in the drive speed in response to an initial increment of applied force becomes greater in response to the same increment in force applied at a relatively greater magnitude of the applied force.

11. System according to claim 1, characterized in that the load-lifting device (6) is operative to move in the direction of two coordinate axes, which are perpendicular with respect to one another, wherein each axis is correlated with a separate motor drive device of the motor drive and with both drive devices being controlled by the sensor device.

12. System according to claim 1, characterized in that the force (F) is detected by a direct force transmission to the sensor device in response to manually produced, force-dependent deflections of the carrying element, which are imposed with respect to a vertical axis.

13. System according to claim 1, characterized in that the sensor device has a measurement unit with the housing and with the measurement body, which is connected with the carrying element via guide rollers, and at least one force detector which is correlated with respective coordinate axes (X—X; Y—Y) or with the respective at least one motor drive device, and which is in contact with the measurement body.

14. System according to claim 13, characterized in that the measurement body is situated in a stationary manner in the direction of a vertical axis, and that for the purpose of raising or lowering a load, the carrying element can move through a centric opening, via the guide rollers, in the measurement body, by sliding longitudinally in the direction of the vertical axis, relative to the measurement body.

15. System according to claim 13, characterized in that the measurement unit has four force detectors that are located in accordance with the two coordinate axes (X—X; Y—Y) that are at an angle of 90°, with respect to one another.

16. System according to claim 13, characterized in that the housing of the measurement device is operative to turn with respect to the measurement body, with the measurement body and the housing being affixed to the boom or an arm of the boom in such a way that when the boom or the at least one arm of the boom is swiveled by at least one angle around at least one corresponding vertical the housing is turned by the same angle or by a summary angle, in such a way that the housing with the force recorders retains its angle orientation, relative to a track construction on which the load-lifting apparatus is disposed.

17. System according to claim 16, characterized in that a coupling rod (58), articulated on one end to the boom and on the other end to the housing is provided so as to turn the housing.

18. System according to claim 16, characterized in that a flexible drive element is provided to turn the housing.

19. System according to claim 16, characterized in that a motor drive is provided to turn the housing.

20. System according to claim 19, characterized in that the motor drive is operative to turn the housing via an electronic evaluation unit.

21. System according to claim 20, characterized in that for the production of signals for the angle, so as to swivel the boom or the at least one boom arm, an incremental rotating angle measurement element is provided, located coaxially with respect to the corresponding vertical axis of the boom or the at least one arm of the boom, wherein the at least one measurement element produces signals corresponding to at least one swivel angle and conducted to the electronic evaluation unit, where an angle is calculated for the motor drive for the subsequent movement of the force recorders.

22. System according to claim 1, characterized in that as a force detector, the sensor device has at least one wire strain gauge-force transducer, one magnetoelastic transducer, one piezoelectric transducer, or one fiber-optical force transducer.

23. System according to claim 1, characterized in that the load-lifting device (6) is designed as a weight balancer.

24. System according to claim 1, characterized in that the carrying element is correlated with a torque-controlled drive for the vertical movements (Z—Z), which produces, as a function of the load, a constant torque, and that the load is held statically in any position in a vertical direction (Z—Z), with small forces applied manually and acting substantially vertically, bringing about a raising or lowering of the load.

25. System according to claim 1, characterized in that the sensor device forms a structural unit with an operating grip, and in that the sensor device is integrated into the operating grip.

26. The system as in claim 1, wherein the load-lifting device comprises a crane-traveling crab disposed on track elements with respect to the horizontal plane.

27. System according to claim 26, characterized in that an electronic evaluation unit is integrated in a moveable part of the system in the crane-traveling crab.

* * * * *